United States Patent [19]

Trujillo

[11] 4,304,504

[45] Dec. 8, 1981

[54] UNSEGREGATOR SHROUD FOR HOT MIX ASPHALT LAYDOWN MACHINE

[75] Inventor: Jose A. Trujillo, Albuquerque, N. Mex.

[73] Assignee: Riguez Associates, Albuquerque, N. Mex.

[21] Appl. No.: 123,205

[22] Filed: Feb. 21, 1980

[51] Int. Cl.[3] ..... E01C 19/18

[52] U.S. Cl. ..... 404/108

[58] Field of Search ..... 404/108, 91; 198/523, 198/525; 414/299, 334, 335, 528

[56] References Cited

U.S. PATENT DOCUMENTS

| | | | |
|---|---|---|---|
| 1,354,076 | 9/1920 | Stephens | 404/91 |
| 1,356,390 | 10/1920 | Myers | 198/523 X |
| 1,609,404 | 12/1926 | Druce | 404/108 X |
| 1,726,603 | 9/1929 | Allen | 414/299 |
| 3,396,644 | 8/1968 | Banks | 404/108 X |
| 3,515,041 | 6/1970 | Murtaugh | 404/108 |
| 3,572,643 | 3/1971 | Birdsall | 414/528 X |
| 4,011,023 | 3/1977 | Cutler | 404/91 |
| 4,264,213 | 4/1981 | Dillman | 414/299 X |

FOREIGN PATENT DOCUMENTS

| | | | |
|---|---|---|---|
| 1065871 | 4/1967 | United Kingdom | 404/108 |

*Primary Examiner*—Rodney H. Bonck
*Attorney, Agent, or Firm*—Lawrence Harbin

[57] ABSTRACT

An improvement to a laydown machine comprising an unsegregator shroud connected to the ejector chute of the aggregate elevator transporter. The shroud extends around the chute to constrain the path of aggregates as they are fed into the feed box of the paving machine.

5 Claims, 5 Drawing Figures

UNSEGREGATOR SHROUD FOR HOT MIX ASPHALT LAYDOWN MACHINE

BACKGROUND OF THE INVENTION

This invention concerns improvements in hot mix asphalt laydown machines, and more specifically, to an apparatus that desegregates aggregates and prevents segregation of aggregates which normally occurs during laydown operations of hot mix asphalt materials.

Laydown machines are employed to evenly spread hot mix asphalt paving materials for compaction by heavy rollers. Plant-mixed hot-laid asphalt mixtures are generally dumped on a prepared pavement subgrade. After the hot mixture is dumped onto the prepared surface, the laydown elevator, in operation, scoops the hot mix from the prepared surface into the laydown machine storage box. The hot mix then is carried upwardly by a feed belt into an ejector chute which ejects the mixture into a feedbox of the laydown machine. The mixture is further heated and then is evenly spread by the paving machine which forms a portion of the laydown machine. One difficulty encountered during laydown operations is the accomplishment of consistency and uniformity in the compacted asphalt mixture. Present methods for countering non-uniformity and inconsistency in the asphalt material include the use of laborers for leveling, raking, and spreading the mixture at certain locations by constant shoveling and raking as the laydown machine operates.

Thus the extent of uniformity and consistency in the compacted asphalt pavements is limited by the level of skill, diligence, and thoroughness of the shovelers and rakers that follow the laydown machine along its course of operation. Most raking operations cause segregated pockets of coarse aggregate which subsequently result in "pot holes". These pockets generally go undetected because the finer particles cover the segregated pockets.

SUMMARY OF THE INVENTION

An object of my invention is to provide an improvement to conventional laydown equipment the reduces that need for such laborers and also enhances uniformity and consistency in the asphalt mixture produced by the paving machine.

Another object is to provide an apparatus which is readily adapted to be incorporated with conventional laydown machines.

It is another object to provide such an improvement economically.

In accordance with this invention, an improvement to conventional laydown machines is provided by adding an unsegregator shroud around the ejector chute of the elevator lift. The preferred unsegregator shroud comprises several vertically hanging flexible rubber portions which constrain the path of the ejected aggregates particles when ejected into the feed box.

In discovering my invention, I recognized that the paths of the ejected aggregates as they are fed to the feed box differs according to the size of the aggregates. For example, larger sized aggregates are slung forwardly in the feed box at higher speeds and with greater force while the smaller sized aggregates generally fall vertically downwardly into the feed box. Thus without the use of my unsegregator shroud, the larger aggregates accumulate at the outermost sides of the feed box while the smaller sized aggregates accumulate at center location in the feed box. When the aggregate mixture is withdrawn by feed belts from the feed box into a heater and spreader, different areas of the mix spread contain different aggregate compositions. Thus the pavement is inconsistent and non-uniform. Accordingly, my unsegregator shroud, when used with a conventional laydown machine, prevents segregation of aggregates.

My invention has several advantages. The most important advantage is the elimination of the shovelers and rakers which are normally required for use of conventional laydown machines. The elimination of such laborers decreases the cost for producing a pavement. Another advantage is the achievement of uniform and consistent asphalt pavement which meets the predesignated design specifications. Those design specifications establish the physical properties of this asphalt surface so that the pavement surface may serve its intended purpose. The structural layer will then be uniform. Specifically, physical properties such as air voidage, stability, flexibility, workability, frictional qualities, and stability are desired. A uniform mix when laid and compacted will produce a pavement having those predesignated physical properties.

Other advantages, features, and aspects of my invention will become readily apparent upon review of the succeeding disclosure taken in connection with the accompanying drawings.

DESCRIPTION OF AN ILLUSTRATIVE EMBODIMENT

Figure 1:
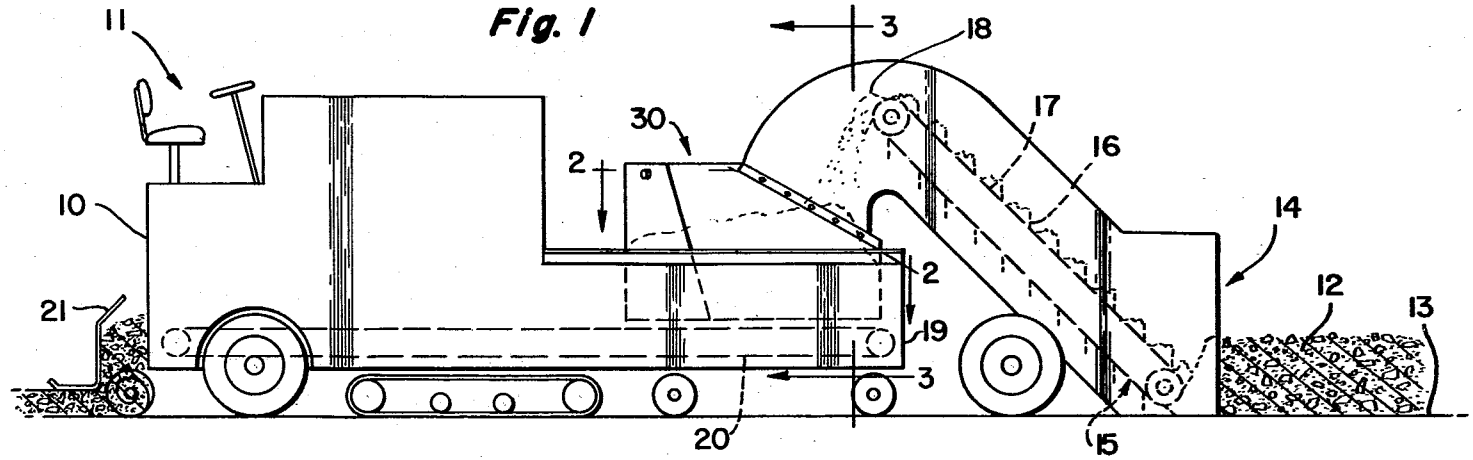
FIG. 1 depicts a sideview of a conventional laydown machine which embodies the improvement of my invention.

FIG. 1 shows a conventional laydown machine now in use by many paving contractors. A laydown machine 10 typically comprises an elevator portion and a paving portion which are connected for simultaneous operation. An operator normally sits at station 11 and drives the machine forwardly to pick up a hot mix of material 12 that was previously dumped by a dump truck on the prepared surface 13. As the machine is driven forwardly, the hot mix is scooped into the front opening 14 of the laydown machine and then is elevated by a conveyor-type elevator lift 15 that includes a series of flanges 16 for carrying the hot material on the surface 13 on the belt 17 upwardly to ejector chute 18. The hot mix 12 finally is dumped into the feed box 19. The feed box 19 may include heaters, not shown, for maintaining the temperature of the hot mix generally between 200 degrees to 250 degrees Fahrenheit. The hot mix material 12 is withdrawn from the bottom portion of feed box 19 by a series of feed belts 20 and is carried through the laydown machine wherein it is processed by spreading on the pavement 13 by a regulating spreader 21 at the rear of the laydown machine 10. The types of laydown machine in which I use my improvement are known as Blaw-Knox or Barber Green.

Figure 3:
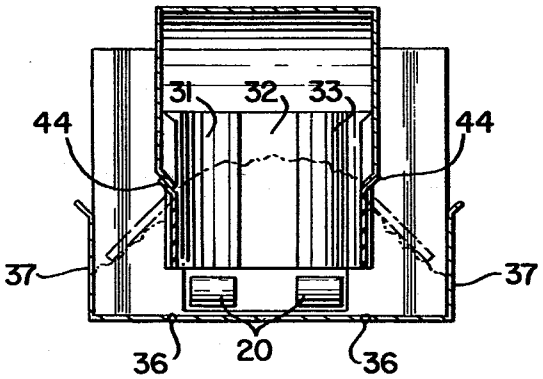
FIG. 3 depicts a cross-sectional view taken across lines 3—3 of FIG. 1.

My invention comprises the use of an unsegregator shroud 30 which is coupled at its upper portion to the mouth of the ejector chute 18. The lower portion of the unsegregator shroud hangs freely and extends approximately six inches above the feed belts 20. The preferred embodiment of the shroud shown in FIG. 3 comprises three separate flexible pieces 31, 32, and 33 which are fastened together at the top portion. The bottom portions of the shroud are then free to spread open as the feed box is filled with the hot mix.

The shroud assembly is bolted together by two nut and bolt assemblies 34 at their upper portions. Shroud piece 32 assumes a semicircular form when connected to the elevator gusset as shown. Shroud piece 32, when laid flat, is wider at the bottom and narrower at its upper end. The upper end of shroud pieces 31 and 33 are attached to a flange 41 of the elevator gusset of the ejector chute of the elevator lift. The geometric shape of shroud piece 32 is trapezoidal, as shown.

Figure 5:
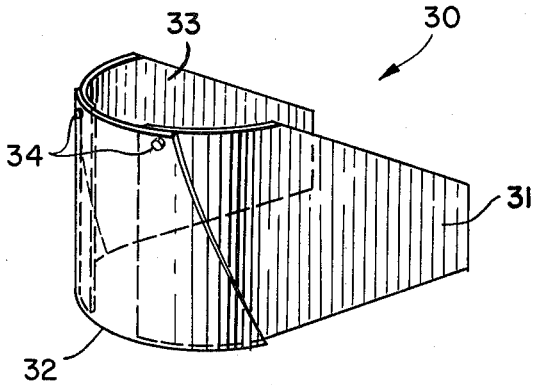
FIG. 5 is a perspective view of the unsegregator shroud of this invention.

I construct the unsegregator shroud 30 from rubber having a thickness of at least one-fourth inch or greater. Other flexible materials also can be used so long as the high temperature operating environment is considered in selecting a flexible material. A flexible material allows the shroud 30 to be deflected outwardly by the aggregate pile in the feed box as the box fills and retracts inwardly as the aggregate pile is depleted by the feed belts. Thus a self adjusting action of the shroud is provided for continuously constraining the path of the ejected aggregates and desegregating previously segregated aggregates. FIG. 5 shows the preferred construction shroud in perspective.

Figure 4:
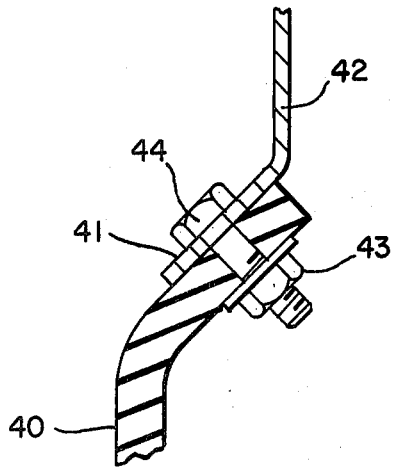
FIG. 4 shows a cross-sectional view of the connecting flange for the unsegregator shroud.

The details of the attachment to the elevator gusset is shown in FIG. 4 wherein an upper portion 40 of the shroud is fixedly attached to a lip 41 of the elevator gusset 42 by a nut 44 and bolt 43. The lip 41 protrudes from the gusset forty-five degrees downwardly from the horizontal so that aggregates do not accumulate on the ledge formed by the lip. Only the two side pieces 31 and 33 of the three piece shroud are attached to the lip 41. Each side of the chute contains a lip 41 for supporting the unsegregator shroud 30.

Figure 2:
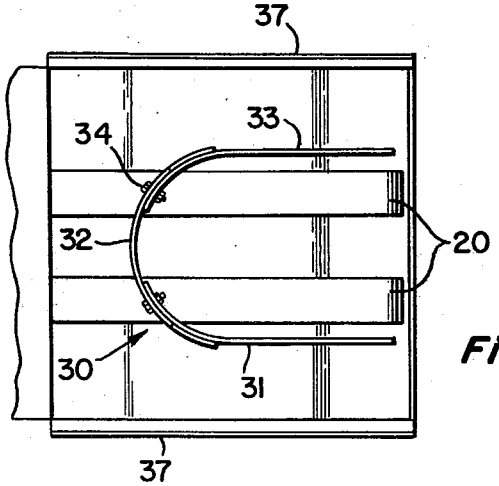
FIG. 2 depicts a cross-sectional view taken along line 2—2 of FIG. 1.

Hinged wings 37 shown in FIG. 2 are provided on both sides of the feed box 19 each of which carry surplus asphalt paving mixtures for maintaining continuity in mix flow from the feed box 19 to the feed belts 20 when the belly-dumped hot mix located on prepared surface 13 becomes discontinuous. Discontinuity in the belly belt mix results from multiple uneven belly dumps at different locations on the prepared surface 13 by the dump trucks. When the supply of belly-dumped hot mix runs low, the hinged wings 37 are rotated inwardly under hydraulic force on hinges 36 to further supply the feed box 19 for supplying additional materials 12 to the feed belts 20 when otherwise unavailable. Thus, continuity in materials supplied is maintained.

As previously indicated, aggregates of hot mix 12 have a tendency to segregate within the feed box by size as a result of dumping on the surface 13 and differing paths of ejected aggregates supplied to the feed box. I discovered these reasons to be the principle cause of segregation. During my observation, I noted that the heavier aggregates have a tendency to be ejected with greater force and thereby travel to a different location within the feed box 19 without the use of the unsegregator shroud 30. The smaller sized aggregates have a tendency to fall vertically downwardly into the feed box 19. Further, if all aggregates were directed vertically downward into the feed box, the heavier aggregates would have a tendency to roll over to the side and front portions of an aggregate pile that would be formed in the feed box.

Aggregates of the belly dump 12 while on the surface 13 also have a tendency to segregate in that the heavier aggregates roll to the side of the aggregate pile. As these aggregates are lifted by the elevator 15 into the chute 18, they are lifted and ejected ununiformly. My unsegregator shroud prevents segregation of aggregates as previously explained and additionally, desegregates aggregates that have already segregated during dumping operations. Accordingly, a more uniform mixture of aggregates is maintained in the feed box 19, the uniformity of the mixture is retained as the aggregates are withdrawn by the feed belts 20 to the spreader 21 at the rear of the laydown machine 10, and better quality pavements can be produced at a lower cost by reducing the number of laborers required for a job.

The physical embodiment of the shroud which I describe can be altered somewhat to achieve the same results. It is my intent to cover in my claims those structures which unsegregate and prevent segregation of aggregates when used with laydown equipment comprising an elevator means which eject aggregates into a feed box. Other structures performing the same results can be contrived by persons skilled in the art to which this subject matter pertains. It is my intent to include all such modifications and structures which achieve the described results. Accordingly, the scope of my invention is pointed out by the appended claims rather than by the above description.

What is claimed as new and desired to be secured by Letters Patent of the United States is:

1. An improved laydown machine comprising a paving machine for spreading hot-mix asphalt mixtures, said paving machine including feeding box means for storing asphalt materials that are supplied to said paving machine, and elevator means for transferring hot mix from the road surface to said feeding box means, wherein the improvement comprises:

unsegregating means disposed between elevator means and feeding box means for unsegregating aggregates of a hot-mix asphalt paving mixture wherein said unsegregating means comprises a flexible shroud means disposed around the output of said elevator means for constraining the path of aggregates transferred by said elevator means to said feeding box means.

2. The invention as recited in claim 1 wherein said flexible shroud comprises plural members that hang substantially vertically, said members being coupled together at the upper portion so that the lower portion thereof may freely expand outwardly thereby to adapt to varying sizes of aggregate piles in the feeding box means.

3. The invention as recited in claim 2 wherein at least one of said plural members of said flexible shroud has a trapezoidal geometrical shape, the upper portion being narrow and the lower portion being wide, for constraining the path of ejected aggregates when the bottom portion of said flexible shroud expands outwardly as a result of an aggregate pile that accumulates in said feeding box means.

4. The invention as recited in claim 3 wherein said flexible shroud is connected to said elevator means by connection flange means.

5. The invention as recited in claim 4 wherein the connection flange means is located on the periphery of the output of said elevator means and comprises a flange member extending angularly downward for preventing accumulation of aggregates thereon.

* * * * *